US008672717B2

(12) United States Patent
Li et al.

(10) Patent No.: US 8,672,717 B2
(45) Date of Patent: Mar. 18, 2014

(54) ELECTRICAL CONNECTOR ASSEMBLY

(76) Inventors: Alwyn Ted Li, Plano, TX (US); Lai Sang Juliana Lam, San Francisco, CA (US)

( * ) Notice: Subject to any disclaimer, the term of this patent is extended or adjusted under 35 U.S.C. 154(b) by 210 days.

(21) Appl. No.: 13/273,194

(22) Filed: Oct. 13, 2011

(65) Prior Publication Data

US 2013/0095706 A1 Apr. 18, 2013

(51) Int. Cl.
*H01R 11/22* (2006.01)

(52) U.S. Cl.
USPC ..... 439/822; 439/829

(58) Field of Classification Search
USPC ..... 439/816, 819, 822, 828, 829, 834
See application file for complete search history.

(56) References Cited

U.S. PATENT DOCUMENTS

| | | | | | |
|---|---|---|---|---|---|
| 2,373,070 | A * | 4/1945 | Wulstein | ..... | 439/829 |
| 3,008,114 | A * | 11/1961 | Adkins | ..... | 439/224 |
| 4,555,155 | A * | 11/1985 | Drake | ..... | 439/592 |
| 5,167,529 | A * | 12/1992 | Verge | ..... | 439/504 |
| 5,928,022 | A * | 7/1999 | Moeller | ..... | 439/197 |
| 6,238,253 | B1 * | 5/2001 | Qualls | ..... | 439/759 |
| 7,008,259 | B2 * | 3/2006 | Agnew | ..... | 439/504 |
| 7,104,815 | B2 * | 9/2006 | Ng et al. | ..... | 439/135 |
| 8,047,671 | B2 * | 11/2011 | Fan et al. | ..... | 362/119 |

* cited by examiner

*Primary Examiner* — Neil Abrams
*Assistant Examiner* — Travis Chambers
(74) *Attorney, Agent, or Firm* — Gregory Perrone; Braxton, Hilton & Perrone, PLLC

(57) ABSTRACT

An improved connector assembly that provides stabilization of a compression member and the junction between two body parts by securing a compression member between the two body parts with multiple posts extending from each body part and providing a stopper at a union point of the body parts.

8 Claims, 2 Drawing Sheets

ELECTRICAL CONNECTOR ASSEMBLY

TECHNICAL FIELD OF THE INVENTION

This invention relates, in general, to an improved electrical connector to prevent product failure due to introduction of physical forces and, in particular, to a test lead and clip assembly having structural enhancements that prohibit failure of a compression member and clip.

BACKGROUND OF THE INVENTION

Electrical connectors are of primary importance in facilitating operation of an endless number of devices. The marketplace is flooded with connectors to meet the needs of virtually any electrically based project. Connectors take many forms. One common form of connector is a test lead and clip assembly. Such clips typically are composed of two main body parts. One end of the clip comes in contact with a conductor of interest. A compression section of the clip is formed by an interlocking connection of the two body parts of the clip. This compression section serves as a mechanism to open the clip by squeezing or compressing the clip at the compression section. Once this compression section is compressed and the conductive material of interest is introduced to the open first end of the clip, the compression section of the clip in may be released or decompressed, causing the first end of the clip to close and attach to the conductive material of interest.

Electrical test leads and clips are used in numerous settings. Electrical clips are also used in various applications in which physical forces are applied to the clip. At times, clips are used in a setting in which repeated opening and closing of the clip is necessary. At other times, the clips are used in a way in which torque is applied to the clip, causing a twisting motion of its body. Regardless of the type of force applied to the clip, such physical force applied to the clip over time will cause the clip to weaken and eventually fail.

A variety of electrical clips are known in the art. Many clips have two main body parts with each body part joined together to form a two-ended clip. A first end forms a point composed of two matching ends of the body parts. A compression section is formed of the opposite matching sections of the two body parts. When pressure is exerted on the compression section, the clip opens and within the open end a conductor or object of interest may be introduced. When pressure is removed from the compression section, the clip closes onto the conductor of interest. The compression section of these clips often includes a compression member, such as a spring. The spring is situated in an opening between the two body parts.

These compression type of clips suffer from significant drawbacks. Since these components are mass produced and purchased and used in high volumes, attention to longevity and quality of the clip is often overlooked. Repeated opening and closing of the clip by exerting force to the compression area causes the compression member, such as a spring, to shift or become deformed within the opening formed between the two body parts. The shifting or movement of the spring causes deformation of the spring itself that prohibits effective opening and closing of the clip. In addition, movement of the spring within the clip causes misalignment of the main body parts of the clip, prohibiting effective operation of the clip. Movement and deformation of the spring and misalignment of the clip's main body parts may also cause the two body parts of the clip to separate, rendering the clip useless. Regardless of the manner in which the structure of the clip is compromised, separation of the body parts or ineffective closure of the clip causes a breach in the clip and ultimately a failure in the clip's intended purpose. What is needed in the electrical clip market, therefore, is an enhanced electrical clip that offers both the structural strength necessary to endure repetitive use and forces applied to it and ease of manufacturing to meet the cost constraints of the typical user.

BRIEF DESCRIPTION OF THE DRAWINGS

Claimed subject matter is particularly pointed out and distinctly claimed in the concluding portion of the specification. However, such subject matter may be understood by reference to the following detailed description when read with the accompanying drawings.

Figure 1A:
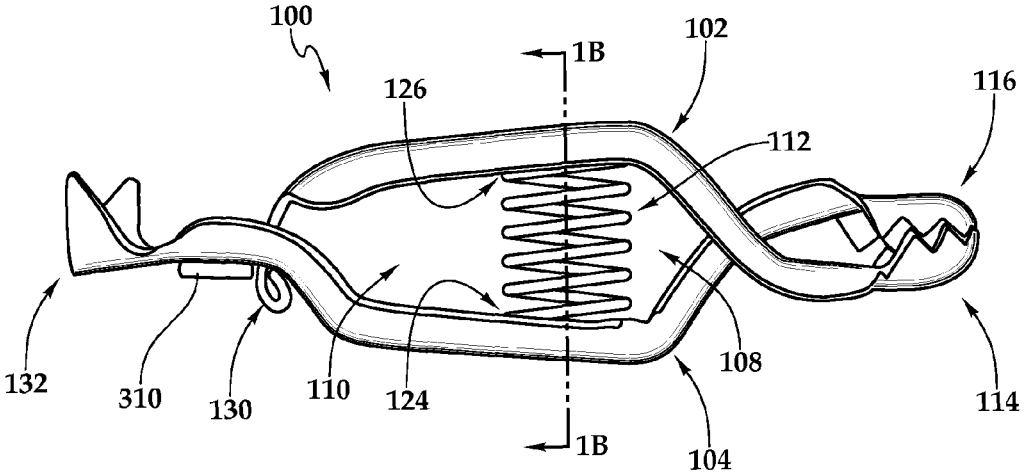
FIG. 1A is a diagram of a clip having a first body portion and a second body portion and a secured compression member between each body portion in accordance with one or more embodiments.

It will be appreciated that for simplicity and/or clarity of illustration, elements illustrated in the figures have not necessarily been drawn to scale. For example, the dimensions of some of the elements may be exaggerated relative to other elements for clarity. Further, if considered appropriate, reference numerals have been repeated among the figures to indicate corresponding and/or analogous elements.

DETAILED DESCRIPTION OF THE EMBODIMENTS

In the following detailed description, numerous specific details are set forth to provide a thorough understanding of claimed subject matter. However, it will be understood by those skilled in the art that claimed subject matter may be practiced without these specific details. In other instances, well-known methods, procedures, components and/or techniques have not been described in detail.

Referring to FIG. 1A, an embodiment of an enhanced electrical clip is shown. Clip 100 is composed of two main body parts. An upper body part 102 and a lower body part 104. Clip 100 is a two-ended clip. A first end is formed of a first gripping end 114 of upper body part 102 and a second gripping end 116 of lower body part 104. The first and second gripping ends 114 and 116 include teeth that serve to grip a material introduced to the clip to form a sturdy connection. Clip 100 includes a compression area 108 formed primarily of central sections of upper body part 102 and lower body part 104.

Figure 2:
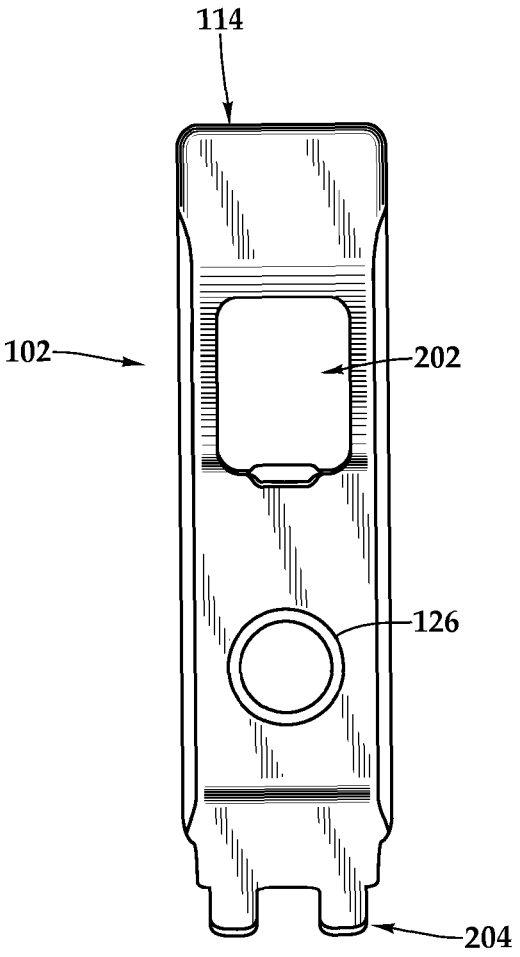
FIG. 2 is a diagram of a top view of a first body portion of an electrical clip in accordance with one or more embodiments.
Figure 3:
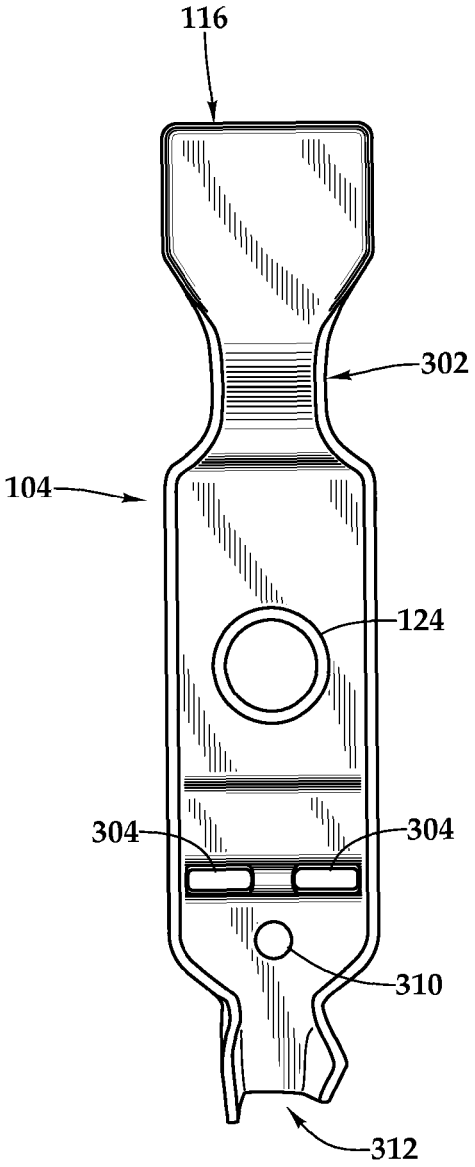
FIG. 3 is a diagram of a top view of a second body portion of an electrical clip in accordance with one or more embodiments.

The manner in which upper body part 102 and lower body part 104 are joined is understood through reference to FIGS. 2 and 3. In FIG. 2, a top view of upper body part 102 is shown. Upper body part 102 includes first gripping end 114, open area 202, tabs 204 and post 126. In FIG. 3, a top view of lower body portion 104 is shown. Lower body portion 104 includes second gripping end 116, throat 302, slots 304 and post 124. Lower body portion 104 also includes connection area 310.

Open area 202 of upper body part 102 is of sufficient size to allow second gripping end 116 to pass through it.

In one embodiment, assembly of upper body part 102 and lower body part 104 is performed by interlocking these two body parts. Upper body part 102 and lower body part 104 are interlocked by inserting the second gripping end 116 of lower body part 104 through open area 202 of upper body part 102. In order for second gripping end 116 to pass through open area 202, second gripping end 116 must be positioned in a substantially perpendicular manner to open area 202. Once throat 302 of lower body portion 104 substantially occupies open area 202, lower body potion 104 is rotated roughly ninety degrees placing upper body portion 102 and lower body portion 104 in a parallel position with each other.

Referring back to FIG. 1A, clip 100 includes a space 110 formed between the upper body part 102 and lower body part 104. A compression member, such as spring 112, may be inserted in space 110 between upper body part 102 and lower body part 104. Spring 112 serves to keep and/or return clip 100 to a closed position following introduction of a compression force by the user to compression area 108. In operation of the clip 100, a user squeezes or compresses the upper body part 102 and lower body part 104 together by applying opposite force on each body part in the compression area 108. This force causes the first gripping end 114 and the second gripping end 116 to separate, allowing a conductive material or other object of interest to be introduced to the clip. The exertion of force to the compression area 108 causes the compression member, such as spring 112, to compress. Once the force exerted on compression area 108 is removed, spring 112 decompresses, causing the first gripping end 114 and second gripping end 116 to return to an at-rest or closed position and to close or grip onto the introduced conductive material or other object of interest.

The compression member, such as spring 112 that occupies space 110 is in contact with upper body part 102 and lower body part 104. Forces exerted on upper body part 102 and lower body part 104 of clip 100, in general, cause spring 112 within space 110 to experience lateral movement and deformation. If not prevented, spring 112 will ultimately move into a position that will compromise the ability to open and close clip 100 and cause the upper body part 102 and lower body part 104 of clip 100 to separate. If not prevented, this separation will cause the first gripping end 114 and second gripping end 116 of clip 100 to disassociate from the conductive material of interest, thus defeating the desired purpose of clip 100. Referring to FIG. 1A, to eliminate the lateral movement of spring 112 within space 110, posts 124 and 126 are located within space 110 on the inner faces of upper body part 102 and lower body part 104. Posts 124 and 126 are aligned with each other along a vertical axis of clip 100. Each of post 124 and 126 are shaped in accordance with the compression member. In one embodiment, if compression member is spring 112, which is cylindrical in shape, each post 124 and 126 will be substantially round. The diameter of each post 124 and 126 will be substantially equal to the inner diameter of spring 112. In the alternative, if the compression member is a device having a different shape, the perimeter length of each post 124 and 126 will be substantially equal to the inner or outer perimeter length of the face of the compression member that contacts the inner face of upper body part 102 and lower body part 104 of clip 100.

Figure 1B:
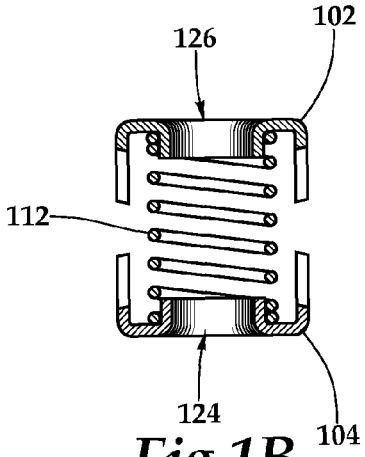
FIG. 1B is an expanded view of a stabilization assembly in accordance with one or more embodiments.

FIG. 1B provides an enhanced view of the association between spring 112 and posts 124 and 126. As shown in this embodiment, posts 126 and 124 extend from the inner faces of the upper body part 102 and lower body part 104, respectively, of clip 100. Spring 112 in this embodiment is cylindrical, having two ends. One end of spring 112 is fitted over post 126 and the other end of spring 112 is fitted over post 124.

In one embodiment, post 126 extends into space 110 from an inner face of the upper body part 102 and post 124 extends into space 110 from an inner face of the lower body part 104. These posts may be formed by punching holes through the exterior faces of upper body part 102 and lower body part 104. Doing so creates posts 124 and 126 that extend towards space 110 having a height sufficient to secure the ends of spring 112. In the alternative, posts 124 and 126 may be adhered to the inner surfaces of lower body part 104 and upper body part 102, respectively, using a suitable fastener or adhesive known in the art. Posts 124 and 126 are able to receive the opposite ends of the employed compression member, providing the desired stability and security.

In order for posts 126 and 124 to stabilize spring 112 and prevent significant lateral movement of spring 112 during compression and release of clip 100, posts 124 and 126 are formed of a size substantially equal to the size of the spring 112. That is, for assemblies in which the end of spring 112 is fitted over posts 124 and 126, the diameter of posts 124 and 126 are substantially equal to the inner diameter of spring 112. This provides a tight fit of spring 112 over posts 124 and 126. For those assemblies in which posts 124 and 126 receive the respective end of spring 112, the inner diameter of posts 124 and 126 are substantially equal to the outer diameter of spring 112. For those assemblies in which posts 124 and 126 receive the ends of spring 112, the post will be largely hollow.

In one embodiment, posts 124 and 126 are formed by punching holes through the upper body part 102 and lower body part 104 of clip 100 along the z-axis shown in FIG. 1A. The punching of holes results in posts 124 and 126 shown in FIGS. 2 and 3. The posts 124 and 126 take the form of a raised circular lip having a diameter substantially equal to the inner diameter of spring 112. In the alternative, a post having similar dimensions may be affixed to each inner face of upper body part 102 and lower body part 104. This alternate type of post may be adhered to the inner face of the body party by a suitable bonding material or be affixed by an appropriate fastener.

During assembly of clip 100, as discussed above, upper body part 102 and lower body part 104 are interlocked by inserting second gripping end 116 of lower body part 104 through opening 202 of upper body part 102. During this interlocking process, in one embodiment, one end of spring 112 is inserted over one post 124 and the other end of spring 112 is inserted over another post 126. This insertion process causes spring 112 to be locked into position within space 110 between upper body part 102 and lower body part 104. During the process of joining upper body part 102 and lower body part 104 and fitting the ends of spring 112 onto posts 124 and 126, the upper body part 102 and lower body part 104 are further secured together by joining tabs 204 and slots 304. Tabs 204 are situated at an end of upper body part 102 opposite from first gripping end 114. Slots 304 are situated at an end of lower body part 104 opposite from second gripping end 116. Tabs 204 and slots 304 are manufactured to be in alignment following the interlocking process. To finally secure upper body part 102 to lower body part 104, tabs 204 are inserted in slots 304. In FIGS. 2 and 3, two tabs and two slots are shown, but a single tab or more tabs may be used, depending upon the size of clip 100.

Following insertion of tabs 204 into slots 304, the process of interlocking upper body part 102 and lower body part 104 is largely complete. Tabs 204 are of sufficient length to completely pass through slots 304. In order to firmly secure upper body part 102 and lower body part 104, each of tabs 204 is bent or folded in a manner that prohibits removal of tabs 204 from slots 304. In one embodiment, tabs 204 are bent or turned up to approximately 180 degrees from its inserted position to form a stopper 130. As discussed, the introduction of physical forces and torque to clip 100 causes upper body part 102 and lower body part 104 to twist in opposite directions from each other. By rotating or folding tabs 204 in this manner and turning each of tabs 204 into a stopper 130, tabs 204 may not exit slots 304. By rotating or folding tabs 204 towards the opposite body part 104 after tabs 204 are received by slots 304, stopper 130 is formed that prevents separation of the upper body part 102 and the lower body part 104.

In one embodiment, clip 100 may be manufactured from stainless steel although any suitable material having conductive properties at or near the gripping ends 114 and 116 of clip 100 may be used. If stainless steel is chosen, attachment platform 312 as seen in FIG. 3 is provided to enable soldering of a conductor to one end of clip 100. Attachment platform 312 may be manufactured of copper to permit soldering of a conductor to clip 100 at attachment platform 312. If the main body of clip 100 is made of other material not susceptible to effective soldering, any material on which effective soldering may occur may be chosen for attachment platform 312. Alternatively, a hole may be drilled or punched through lower body part 104 and a screw or other fastener made of conductive material may be inserted into the hole to secure a lead wire introduced to clip 100.

Figure 1C:
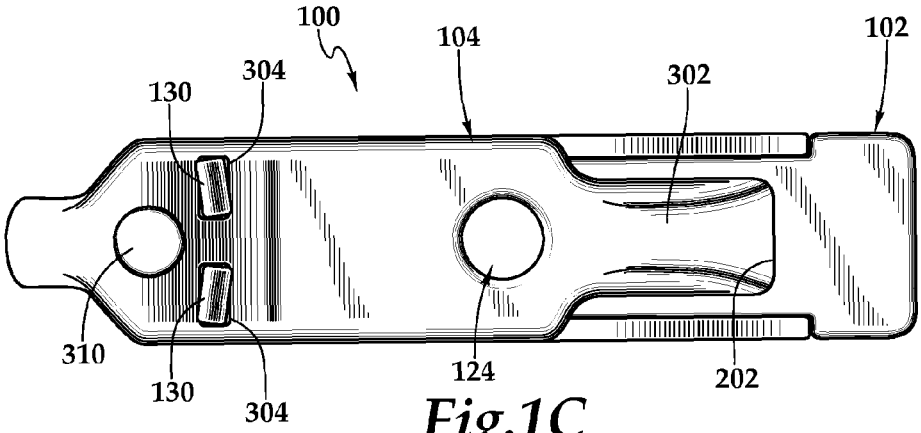
FIG. 1C is a diagram of a clip having a first body portion and a second body portion and a secured compression member in accordance with one or more embodiments.

An alternative view of clip 100 is provided as FIG. 1C. In FIG. 1C, a top view of clip 100 is shown. Clip 100 is composed of lower body part 104 and upper body part 102. Clip 100 includes post 124 formed in lower body part 104 that extends from an inner face of lower body part 104. Clip 100 of FIG. 1C also includes stoppers 130 formed from folding or turning tabs 204 that exit slots 304.

Although the claimed subject matter has been described with a certain degree of particularity, it should be recognized that elements thereof may be altered by persons skilled in the art without departing from the spirit and/or scope of claimed subject matter. It is believed that the subject matter pertaining to electrical clips will be understood by the forgoing description, and it will be apparent that various changes may be made in the form, construction and/or arrangement of the components thereof without departing from the scope and/or spirit of the claimed subject matter or without sacrificing all of its material advantages, the form herein before described being merely an explanatory embodiment thereof, and/or further without providing substantial change thereto. It is the intention of the claims to encompass and/or include such changes.

What is claimed:

1. A clip, comprising:

a first body portion;

a second body portion;

a compression unit having a first end and a second end;

a first post extending from an inner face of the first body portion; and a second post extending from an inner face of the second body portion;

a tab associated with one of the first body portion and the second body portion, and a slot associated with the other of the first body portion and the second body portion for receiving the tab;

wherein the first end of the compression unit receives the first post and the second end of the compression unit receives the second post, and wherein the tab received by the slot is folded to form a stopper interlocking the first body portion and the second body portion.

2. The clip of claim 1, wherein the first post and the second post have a diameter substantially equal to an inner diameter of the compression unit.

3. The clip of claim 1, wherein the first post and the second post have a perimeter length substantially equal to an inner perimeter length of the compression unit.

4. The clip of claim 1, further comprising a conductive platform for associating a conductor with the clip.

5. A clip, comprising:

a first body portion;

a second body portion;

a compression unit having a first end and a second end;

a first post extending from an inner face of the first body portion;

a second post extending from an inner face of the second body portion;

a tab associated with one of the first body portion and the second body portion, and a slot associated with the other of the first body portion and the second body portion for receiving the tab, wherein the first post receives the first end of the compression unit and the second post receives the second end of the compression unit, and wherein the tab received by the slot is folded to form a stopper interlocking the first body portion and the second body portion.

6. The clip of claim 5, wherein the first post and the second post have a diameter substantially equal to an outer diameter of the compression unit.

7. The clip of claim 5, wherein the first post and the second post have a perimeter length substantially equal to an out perimeter length of the compression unit.

8. The clip of claim 5, further comprising a conductive platform for associating a conductor with the clip.

* * * * *